US010123929B2

(12) United States Patent
Celik

(10) Patent No.: US 10,123,929 B2
(45) Date of Patent: Nov. 13, 2018

(54) WRIST AND FOREARM EXOSKELETON

(71) Applicant: Colorado School of Mines, Golden, CO (US)

(72) Inventor: Ozkan Celik, Lakewood, CO (US)

(73) Assignee: COLORADO SCHOOL OF MINES, Golden, CO (US)

( * ) Notice: Subject to any disclaimer, the term of this patent is extended or adjusted under 35 U.S.C. 154(b) by 487 days.

(21) Appl. No.: 14/741,710

(22) Filed: Jun. 17, 2015

(65) Prior Publication Data

US 2015/0359697 A1 Dec. 17, 2015

Related U.S. Application Data

(60) Provisional application No. 62/013,423, filed on Jun. 17, 2014.

(51) Int. Cl.
*A61H 1/02* (2006.01)
*A63B 21/00* (2006.01)
(Continued)

(52) U.S. Cl.
CPC ..... *A61H 1/0285* (2013.01); *A61H 1/0274* (2013.01); *A63B 21/0058* (2013.01);
(Continued)

(58) Field of Classification Search
CPC ..... A61H 1/0285; A61H 1/0274; A61H 2201/5043; A61H 2201/1215; A61H 2201/1671; A61H 1/0296; A61H 2201/1635; A61H 1/0237; A63B 23/03508; A63B 21/4035; A63B 23/14; A63B 21/0058; A63B 21/4049; A63B 21/4034; A63B 2024/0096; A63B 21/00178; A63B 23/1281; A63B 21/00181
See application file for complete search history.

(56) References Cited

U.S. PATENT DOCUMENTS 5,466,213 A 11/1995 Hogan et al.
5,738,636 A * 4/1998 Saringer ..... A61H 1/0266 601/29
(Continued)

OTHER PUBLICATIONS

"InMotion ARM Interactive Therapy System," Interaction Motion Technologies, 2013, retrieved from http://web.archive.org/web/20131021150346/http://interactive-motion.com/healthcarereform/upper-extremity-rehabilitiation/inmotion2-arm/, 7 pages.
(Continued)

*Primary Examiner* — Sundhara Ganesan
(74) *Attorney, Agent, or Firm* — Sheridan Ross P.C.

(57) ABSTRACT

An exoskeleton device and method of using the same is provided that helps rehabilitate limbs such has the lower arm. Embodiments of the exoskeleton device have multiple degrees of freedom so that a limb such as the lower arm may flex or rotate in multiple directions to establish or re-establish neural connections in the brain. With the lower arm example, a person may grasp a handle in the exoskeleton and then flex the lower arm about a pronation/supination axis, a flexion/extension axis, and/or an abductor/adductor axis. The exoskeleton device has several modes of operation where actuators can aid the person's motion, resist the person's motion, or passively allow free motion of the person's limb.

20 Claims, 6 Drawing Sheets

(51) Int. Cl.

| | |
|---|---|
| ***A63B 21/005*** | (2006.01) |
| ***A63B 23/035*** | (2006.01) |
| ***A63B 23/14*** | (2006.01) |
| *A63B 23/12* | (2006.01) |
| *A63B 24/00* | (2006.01) |

(52) U.S. Cl.

CPC ..... *A63B 21/4035* (2015.10); *A63B 21/4049* (2015.10); *A63B 23/03508* (2013.01); *A63B 23/14* (2013.01); *A61H 1/0237* (2013.01); *A61H 1/0296* (2013.01); *A61H 2201/1215* (2013.01); *A61H 2201/1635* (2013.01); *A61H 2201/1671* (2013.01); *A61H 2201/5043* (2013.01); *A63B 21/00178* (2013.01); *A63B 21/00181* (2013.01); *A63B 21/4034* (2015.10); *A63B 23/1281* (2013.01); *A63B 2024/0096* (2013.01)

(56) References Cited

U.S. PATENT DOCUMENTS

| | | | | |
|---|---|---|---|---|
| 6,506,172 | B1 * | 1/2003 | Hepburn | A61H 1/0274 601/33 |
| 7,618,381 | B2 | 11/2009 | Krebs et al. | |
| 8,460,222 | B2 * | 6/2013 | Garrec | A61H 1/0277 482/44 |
| 9,345,634 | B2 * | 5/2016 | Ju | A61H 1/0285 |
| 9,592,174 | B2 * | 3/2017 | Hong | A61H 1/0277 |
| 2003/0115954 | A1 * | 6/2003 | Zemlyakov | A61B 5/022 73/379.01 |
| 2003/0223844 | A1 * | 12/2003 | Schiele | A61H 1/0274 414/5 |
| 2004/0243025 | A1 * | 12/2004 | Peles | A61H 1/0277 601/5 |
| 2007/0225620 | A1 | 9/2007 | Carignan et al. | |
| 2008/0009771 | A1 | 1/2008 | Perry et al. | |
| 2009/0030353 | A1 * | 1/2009 | Bonutti | A61F 5/013 601/5 |
| 2010/0016766 | A1 * | 1/2010 | Zhang | A61F 5/0102 601/5 |
| 2010/0280628 | A1 | 11/2010 | Sankai | |
| 2010/0298097 | A1 * | 11/2010 | Preumont | A61H 1/0237 482/5 |
| 2011/0264018 | A1 * | 10/2011 | Matjacic | A61H 1/0274 601/40 |
| 2011/0282253 | A1 | 11/2011 | Menon et al. | |
| 2011/0313331 | A1 | 12/2011 | Dehez et al. | |
| 2012/0165158 | A1 * | 6/2012 | Ren | A63B 21/00178 482/7 |
| 2012/0330198 | A1 | 12/2012 | Patoglu | |

OTHER PUBLICATIONS

"Robotics: Probing Brain Function and Dysfunction," BKIN Technologies, 2012, retrieved from http://web.archive.org/web/20120826044618/http://www.bkintechnologies.com/index.cfm?page=products, 2 pages.

Hocoma, "The New Armeo®Power," Unknown date, retrieved from http://www.hocoma.com/products/armeo/armeopower/, retrieved on Apr. 11, 2016, 2 pages.

Martinez et al., "Design of Wrist Gimbal: a Forearm and Wrist Exoskeleton for Stroke Rehabilitation," IEEE, 2013, International Conference onRehabiliatation Robotics, Jun. 24-26, 2013, 6 pages.

Saadatzi et al., "Draft: Torque Estimation in a Wrist Rehabilitation Robot Using a Nonlinear Disturbance Observer," ASME, May 2015, Dynamic Systems and Control Conference, Oct. 28- 30, 2015, pp. 1-8.

Saadatzi et al., "Interaction Torque Estimation Algorithm for Wrist Gimbal Rehabilitation Robot," Rocky Mountain American Society of Biomechanics Conference in Apr. 2015, 1 page.

* cited by examiner

WRIST AND FOREARM EXOSKELETON

CROSS-REFERENCE TO RELATED APPLICATIONS

This application claims priority and benefit under 35 U.S.C. § 119(e) to U.S. Provisional Patent Application Ser. No. 62/013,423 filed Jun. 17, 2014, which is incorporated herein in its entirety by reference.

FIELD OF THE INVENTION

The present invention relates to an exoskeleton device for use in rehabilitation of a person's body part, and method of using the same. In some instances, the person may be recovering from a stroke or a spinal cord injury.

BACKGROUND OF THE INVENTION

Many accidents or ailments can result in a person losing function in a body part. For example, nearly 800,000 individuals in the United States experience a new or recurring stroke every year, and the resulting hemiparesis can impair the motor function of a stroke survivor. There are also approximately 12,000 incidences of Spinal Cord Injury (SCI) in the United States each year. In moderate to severe cases, a person may undergo physical therapy in order to restore function to the impaired body part.

Physical therapy is the typical rehabilitation procedure for a person who loses function in a body part, including people who survive a stroke or a spinal cord injury. Some types of physical therapy require one-on-one physical interaction between a therapist and the injured person. While effective in many instances, these types of physical therapy can have several limitations. Due to human nature, different physical therapists may have different techniques, different systems or programs, and different levels of proficiency that result in a wide variety of outcomes for the injured person. In addition, a physical therapist may have difficulty in objectively evaluating the performance of an injured person with quantitative metrics such as the force generated by the injured person's body part or the precise movement trajectory or range of motion of the person's body part expressed in angles, distance, and other similar metrics. A physical therapist may also have difficulty in precise and repeatable application of forces, torques or trajectories to the person's body part.

Some attempts have been made to incorporate machines or robots into the physical therapy process to address some of the deficiencies outlined above. Some examples may be found in U.S. Patent Publication Nos. 2010/0280628, 2008/0009771, 2012/0330198, 2007/0225620, and 2011/0313331, which are incorporated herein in their entireties by reference. In another example, a wrist and upper extremity motion system is described in U.S. Pat. No. 7,618,381 ("the '381 patent"), which is incorporated herein in its entirety by reference. The '381 patent describes a system that secures a person's forearm and permits movement of the person's arm and hand in multiple degrees of freedom. However, the design described in the '381 patent relies on multiple motors interconnected to differential motors and gear systems. This configuration physically limits the range of motion of the person's arm, wrist, and hand in some directions and allows backlash which can deteriorate fidelity of force feedback. The '381 patent presents an "open on top" design, which requires use of limited number of bearings/guides that cannot provide support across a complete rotation. This configuration requires use of bulkier or heavier materials and parts to ensure device rigidity or structural integrity.

These deficiencies, among others, are addressed in the present invention described in detailed below.

SUMMARY OF THE INVENTION

It is therefore an aspect of the present invention to provide an exoskeleton device that supports a full range of motion for the distal end of a person's limb in multiple degrees of freedom. In some embodiments, the distal end of a person's limb can be a person's arm, wrist, and hand. However, it will be appreciated that while some embodiments of the present invention are described with respect to a person's arm, wrist, and hand, embodiments of the invention may apply to other joints such as the leg, neck, etc.

A pronation/supination (P/S) motion refers to the inward and outward twisting of a person's forearm along the length of the person's forearm, and thus one degree of freedom may be an axis of rotation along the length of the person's forearm. A flexion/extension (F/E) movement refers to an articulation of the wrist joint such that the palm travels toward and away from the forearm, and an adduction/abduction (A/A) movement refers to an articulation of the wrist joint such that the thumb side of the hand bends toward and away from forearm. The axes of the A/A and F/E movements through the wrist joint may be second and third degrees of freedom of the exoskeleton device, with respect to the device base. Some embodiments of the invention are directed to a combination of two of the above degrees of freedom, and various embodiments of the invention are directed to three or more degrees of freedom.

Another aspect of the present invention is to provide an exoskeleton device that has a ring bearing located between a limb rest and a handle. This configuration allows a person to rest the upper portion of the person's forearm and grasp a handle of the exoskeleton device without other components of the exoskeleton interfering with the person's arm between the limb rest and the handle. This feature enables a person to have a full range of motion when engaging the exoskeleton device, which is critical to physical therapy.

Some embodiments of the invention provide an exoskeleton that enables three degrees of freedom where a F/E assembly is nested within an A/A assembly, which in turn is nested within a P/S assembly. Each assembly allows for one degree of freedom, and the various assemblies are operably interconnected to each other via bearings or other devices that allow free movement of the various assemblies. Therefore, a person's wrist may be articulated in any direction and engage each available degree of freedom simultaneously.

Some embodiments of the invention provide an exoskeleton device that has multiple modes of operation. In a resistive mode, actuators resist a person's movement in a degree of freedom. If a person moves their arm in a pronation direction, the actuator can resist this movement to help the person, for example, build up muscle strength in that particular movement. In contrast, in an active mode, the actuator can assist or supplement the person's strength to achieve a greater range of motion. This may be beneficial, for example, at an early stage of physical therapy when a person is simply trying to regain a full range of motion. In another mode of operation, the actuators may passively allow a person to freely move the person's arm, wrist, and hand. This passive mode is useful to objectively evaluate the limb's current strength and range of motion.

An aspect of the invention is an exoskeleton device for articulating a limb. The device includes a base with a first pronation/supination (P/S) bearing and a second P/S bearing. The first P/S bearing is a ring bearing that is configured to receive a portion of a limb through it. The device includes a P/S assembly operably interconnected to the base via the first and second P/S bearings. A P/S actuator is operably interconnected to the P/S assembly to rotate the P/S assembly about an axis. The P/S axis, and the P/S assembly has a first auxiliary bearing. The actuator can be connected to the P/S assembly via a cable drive mechanism which involves a capstan and a pulley, to avoid backlash, to reduce friction and to improve force feedback fidelity. The device includes an auxiliary assembly operably interconnected to the P/S assembly via the first auxiliary bearing. An auxiliary actuator is operably interconnected to the auxiliary assembly to rotate the auxiliary assembly about an auxiliary axis. The device also includes a securing feature operably interconnected to the auxiliary assembly. The securing feature is configured to selectively interconnect to a portion of the limb.

An aspect of the invention is an apparatus for articulating a limb. The apparatus includes a base having a first P/S bearing and a second P/S bearing. The apparatus includes a P/S assembly operably interconnected to the base via the first and second P/S bearings. The P/S actuator is operably interconnected to the P/S assembly in order to rotate the P/S assembly about a P/S axis. The P/S assembly includes a first abductor/adductor (A/A) bearing. An A/A assembly is operably interconnected to the P/S assembly via the first A/A bearing. The A/A actuator is operably interconnected to the A/A assembly to rotate the A/A assembly about an A/A axis. The A/A assembly includes a first flexion/extension (F/E) bearing. The F/E assembly is operably interconnected to the A/A assembly via the first F/E bearing. The F/E actuator is operably interconnected to the F/E assembly to rotate the F/E assembly about a F/E axis. The F/E assembly also has a securing feature that is configured to selectively interconnect to a portion of a limb.

An aspect of the invention is an exoskeleton device for articulating a limb. The device includes a base having a first P/S bearing and a second P/S bearing, wherein the first P/S bearing is a ring bearing configured to receive a portion of a limb through the first P/S bearing. The P/S assembly is operably interconnected to the base via the first and second P/S bearings. The P/S actuator is interconnected to the base, and is operably interconnected to the P/S assembly to rotate the P/S assembly about a P/S axis. The P/S assembly has a first F/E bearing and a second F/E bearing. The F/E assembly is operably interconnected to the P/S assembly via the first and second F/E bearings. The F/E actuator is interconnected to the P/S assembly, and the F/E actuator is operably interconnected to the F/E assembly to rotate the F/E assembly about a F/E axis. The F/E axis is substantially perpendicular to the P/S axis. A handle is operably interconnected to the F/E assembly and is configured to selectively interconnect to a portion of the limb. The handle has a handle axis that is substantially parallel to the F/E axis. The handle axis is offset from the F/E axis by an adjustable distance. A limb rest is operably interconnected to the base, and has a vertical adjustment feature that raises and lowers the limb rest relative to the P/S axis, and a lateral adjustment feature that extends and retracts the limb rest relative to said first P/S bearing.

Another aspect of the invention is a method for operating the exoskeleton device. The method may be performed manually or using a program, such as a software program. The method allows for a user to engage a limb to the device and measure or train the different variables associated with the limb.

The method may include an interface, such as a visual interface or virtual environment displayed on a screen or monitor. The interface can contain game-like elements and tasks assigned to the user of the invention for therapy or exercise purposes. The limb of the user coupled with the exoskeleton may act as a controller for the visual interface or tasks.

These and other advantages will be apparent from the disclosure of the present invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the invention and should not necessarily be construed as limiting all embodiments to a particular description. The present invention is set forth in various levels of detail in the Summary of the Invention as well as in the attached drawings and Detailed Description and no limitation as to the scope of the present invention is intended by either the inclusion or non-inclusion of elements, components, etc. in this Summary of the Invention. Additional aspects of the present invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
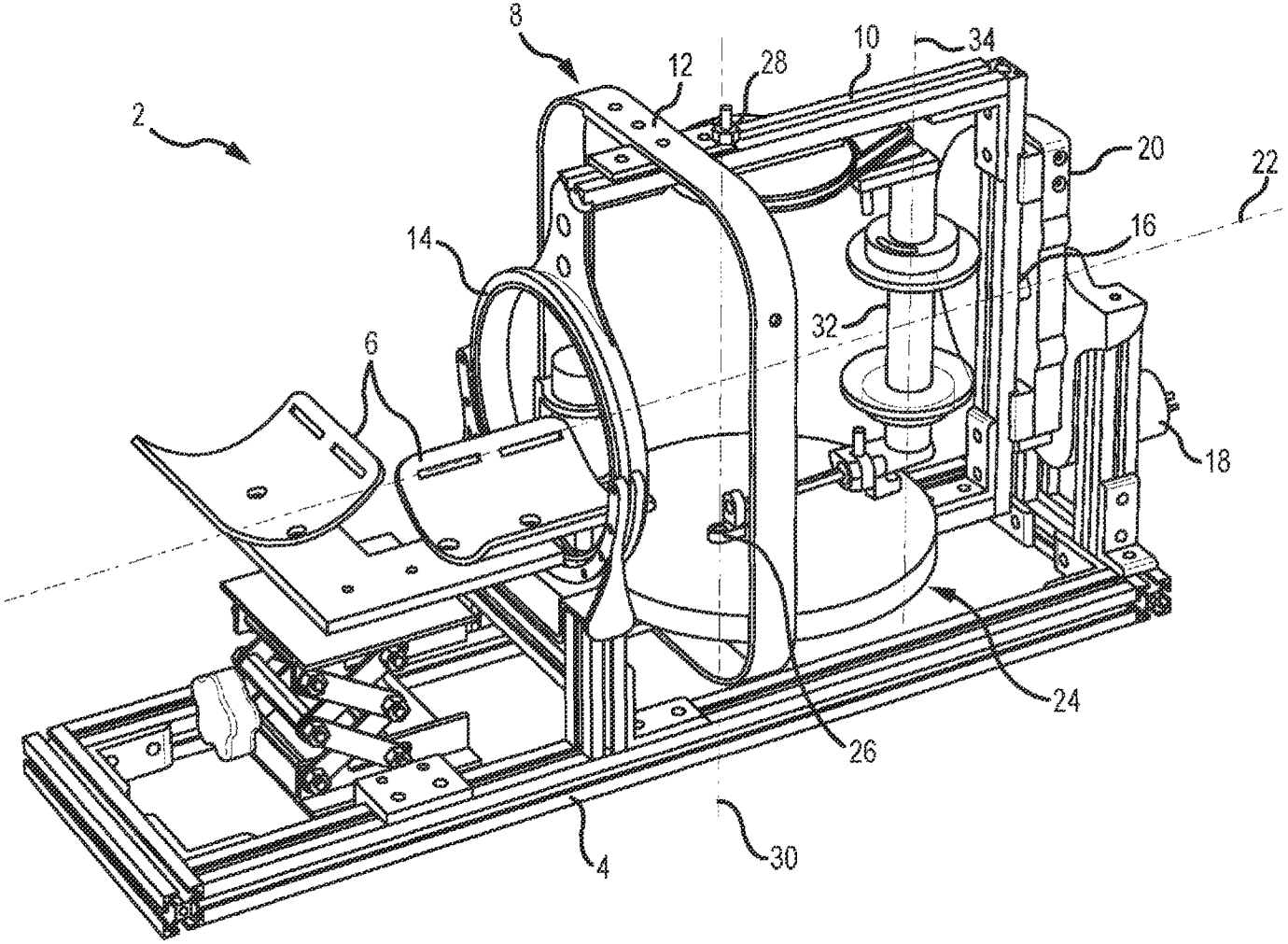
FIG. 1 is a perspective view of an exoskeleton device with two degrees of freedom in accordance with various embodiments of the invention.

To assist in the understanding of the embodiments of the present invention the following list of components and associated numbering found in the drawings is provided herein:

COMPONENT NO. COMPONENT

2 Exoskeleton Device
4 Base
6 Limb Rest
8 Pronation/Supination (P/S) Assembly
10 P/S Longitudinal Frame

12 P/S Lateral Frame
14 First P/S Bearing
16 Second P/S Bearing
18 P/S Actuator
20 P/S Pulley
22 P/S Axis
24 Flexion/Extension (F/E) Assembly
26 First F/E Bearing
28 Second F/E Bearing
30 F/E Axis
32 Handle
34 Handle Axis
36 F/E Actuator
38 F/E Pulley
40 Vertical Adjustment Feature
42 Lateral Adjustment Feature
44 Abductor/Adductor (A/A) Assembly
46 A/A Lateral Frame
48 A/A First Bearing
50 A/A Second Bearing
52 A/A Actuator
54 A/A Pulley
56 A/A Axis It should be understood that the drawings are not necessarily to scale, and various dimensions may be altered. In certain instances, details that are not necessary for an understanding of the present invention or that render other details difficult to perceive may have been omitted. It should be understood, of course, that the present invention is not necessarily limited to the particular embodiments illustrated herein.

DETAILED DESCRIPTION

The present invention has significant benefits across a broad spectrum of endeavors. It is the Applicant's intent that this specification and the claims appended hereto be accorded a breadth in keeping with the scope and spirit of the present invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the present invention into practice is described herein by, and with reference to, the annexed drawings that form a part of the specification. The exemplary embodiment is described in detail without attempting to describe all of the various forms and modifications in which the present invention might be embodied. As such, the embodiments described herein are illustrative, and as will become apparent to those skilled in the arts, and may be modified in numerous ways within the scope and spirit of the present invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

An aspect of the invention is an exoskeleton device for articulating a limb. The device includes a base with a first pronation/supination (P/S) bearing and a second P/S bearing. The first P/S bearing is a ring bearing that is configured to receive a portion of a limb through it. The device includes a P/S assembly operably interconnected to the base via the first and second P/S bearings. A P/S actuator is operably interconnected to the P/S assembly to rotate the P/S assembly about an axis, the P/S axis, and the P/S assembly has a first auxiliary bearing. The device includes an auxiliary assembly operably interconnected to the P/S assembly via the first auxiliary bearing. An auxiliary actuator is operably interconnected to the auxiliary assembly to rotate the auxiliary assembly about an auxiliary axis. The device also includes a securing feature operably interconnected to the auxiliary assembly. The securing feature is configured to selectively interconnect to a portion of the limb.

In embodiments of the device, the securing feature can be a handle. The handle can rotate about a handle axis, which can be substantially parallel to the auxiliary axis. The handle axis can be offset from the auxiliary axis by a predetermined distance. The predetermined distance can be between about 0.5 inches to about 4 inches. In some embodiments, the predetermined distance can be about 0.5 inches, about 1 inches, about 1.5 inches, about 2 inches, about 2.5 inches, about 3 inches, about 3.5 inches, or about 4 inches, or any distance between about 0.5 inches and about 4 inches. In some embodiments, the P/S axis and the auxiliary axis can be substantially perpendicular to each other. In some embodiments, the P/S axis can be offset from the auxiliary axis by a predetermined distance. In some embodiments, the P/S axis and the auxiliary axis may be offset by an angle between about 5 degrees and about 90 degrees. In some embodiments, the P/S axis and the auxiliary axis may be offset by an angle of about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, or about 90 degrees, or any degree between about 5 degrees and about 90 degrees.

A rotation range of the P/S assembly about the P/S axis from a P/S datum position can be between approximately −70 degrees and 85 degrees. In some embodiments, the rotational range may be between any suitable sub range, including about −60 degrees to about 80 degrees, about −50 degrees to about 60 degrees, about −30 degrees to about 85 degrees, about −30 degrees to about 0 degrees, about −70 degrees to about 0 degrees, about 0 degrees to about 85 degrees. In some embodiments, the auxiliary assembly can rotate the limb about a A/A axis or a F/E axis. The rotation range of the A/A assembly about the A/A axis from an A/A datum position can be between approximately −20 degrees and 35 degrees. The rotational range may be any suitable sub range, including between about −20 degrees about 0 degrees, about −20 degrees to about 30 degrees, about −10 degrees to about 0 degrees, about 0 degrees to about 35 degrees, about 0 degrees to about 25 degrees, or about −5 degrees to about 10 degrees. The rotation range of the F/E assembly about said F/E axis from a F/E datum position is between −70 degrees and 75 degrees. The rotational range may be any suitable sub range, including between about −70 degrees to about 0 degrees, 0 degrees to about 70 degrees, −60 to about 60 degrees, −30 to about 30 degrees, about −30 to about 75 degrees or about −70 degrees to about 30 degrees.

The P/S actuator can be interconnected to the base. In some embodiments, the auxiliary actuator can be interconnected to the P/S assembly.

The device can further include a second auxiliary bearing disposed on the P/S assembly. The auxiliary assembly can be operably interconnected to the P/S assembly via the second auxiliary bearing. Some embodiments of the invention to provide an exoskeleton with two or more actuators in a balanced position such that a latent or residual torque is not imparted on the degree of freedom related to the position. At least one actuator may be used for each degree of freedom. In the above example where the various assemblies are nested within each other, actuators drive the motion of the various assemblies, and the actuators are interconnected to some of the assemblies. For example, an auxiliary actuator is interconnected to the P/S assembly. If these actuators are placed on the same side of the axis about which the P/S assembly rotates, the P/S axis, then a torque is imparted on the P/S assembly. However, if these actuators are positioned on opposite sides of the P/S axis, then the torques imparted on the P/S axis are equal and in opposite directions such that the torques "cancel" out, and the various assemblies are in balance without a latent or residual torque imparted on any of the assemblies. In some embodiments, at least one weight or one spring may also be used to "cancel" out torques due to gravity.

The P/S actuator and/or the auxiliary actuator can have a resistive mode, an active mode and/or a passive mode. The resistive mode can inhibit the motion of the limb. The active mode can assist the motion of the limb. The passive mode can allow for free motion of the limb.

The exoskeleton device can include a limb rest, which can be operably interconnected to the base. The limb rest can have a vertical adjustment feature that raises and lowers the limb rest relative to the P/S axis. The limb rest can have a lateral adjustment feature that extends and retracts the limb rest relative to the first P/S bearing. The limb rest can be a single piece, or multiple pieces.

Some or all of the apparatus may be made from metal, polymers or combinations thereof. In some embodiments, it may be beneficial to produce some or part of the apparatus from materials that make the apparatus light, but durable, such as titanium or carbon composites. In some embodiments, heavier metals, such as aluminum, may be used.

The base can be integrated to a table. In some embodiments of the invention, the device is in electronic communication with a display unit. The motion of a person's limb in the multiple degrees of freedom may affect what is displayed on the display unit, such as range, resistance, force, torque, and the like, for a user or another to review. Thus, a person's movement may allow the person to interact with games or other scenarios that make the person's use of the exoskeleton device more enjoyable.

An aspect of the invention is an apparatus for articulating a limb. The apparatus includes a base having a first P/S bearing and a second P/S bearing. The apparatus includes a P/S assembly operably interconnected to the base via the first and second P/S bearings. The P/S actuator is operably interconnected to the P/S assembly in order to rotate the P/S assembly about a P/S axis. The P/S assembly includes a first abductor/adductor (A/A) bearing. An A/A assembly is operably interconnected to the P/S assembly via the first A/A bearing. The A/A actuator is operably interconnected to the A/A assembly to rotate the A/A assembly about an A/A axis. The A/A assembly includes a first flexion/extension (F/E) bearing. The F/E assembly is operably interconnected to the A/A assembly via the first F/E bearing. The F/E actuator is operably interconnected to the F/E assembly to rotate the F/E assembly about a F/E axis. The F/E assembly also has a securing feature that is configured to selectively interconnect to a portion of a limb.

In embodiments of the apparatus, the securing feature can be a handle. The handle can rotate about a handle axis, which can be substantially parallel to an auxiliary axis such as the A/A axis or the F/E axis. The handle axis can be offset from the F/E axis by a predetermined distance. The predetermined distance can be between about 0.5 inches to about 4 inches. In some embodiments, the predetermined distance can be about 0.5 inches, about 1 inches, about 1.5 inches, about 2 inches, about 2.5 inches, about 3 inches, about 3.5 inches, or about 4 inches, or any distance between about 0.5 inches and about 4 inches. This distance can also be made adjustable. In some embodiments, the P/S axis and the F/E axis can be substantially perpendicular to each other. In some embodiments, the P/S axis can be offset from the F/E axis by a predetermined distance, wherein the offset between two axes can be characterized as the minimum distance between the P/S axis and the F/E axis. In some embodiments, the P/S axis and the F/E axis may be offset by an angle between about 5 degrees and about 90 degrees. In some embodiments, the P/S axis and the F/E axis may be offset by an angle of about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, or about 90 degrees, or any degree between about 5 degrees and about 90 degrees. In some embodiments, the A/A axis can be substantially perpendicular to either the P/S axis and/or the F/E axis, or may be offset by a predetermined distance or angle. In some embodiments, the A/A axis and the P/S axis can be offset by an angle between about 5 degrees and about 90 degrees. In some embodiments, the A/A axis and the P/S axis may be offset by an angle of about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, or about 90 degrees, or any degree between about 5 degrees and about 90 degrees. In some embodiments, the A/A axis and the F/E axis can be offset by an angle between about 5 degrees and about 90 degrees. In some embodiments, the A/A axis and the F/E axis may be offset by an angle of about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, or about 90 degrees, or any degree between about 5 degrees and about 90 degrees.

A rotation range of the P/S assembly about the P/S axis from a P/S datum position can be between approximately −70 degrees and 85 degrees. In some embodiments, the rotational range may be between any suitable sub range, including about −60 degrees to about 80 degrees, about −50 degrees to about 60 degrees, about −30 degrees to about 85 degrees, about −30 degrees to about 0 degrees, about −70 degrees to about 0 degrees, about 0 degrees to about 85 degrees. The rotation range of the A/A assembly about the A/A axis from an A/A datum position can be between approximately −20 degrees and 35 degrees. The rotational range may be any suitable sub range, including between about −20 degrees about 0 degrees, about −20 degrees to about 30 degrees, about −10 degrees to about 0 degrees, about 0 degrees to about 35 degrees, about 0 degrees to about 25 degrees, or about −5 degrees to about 10 degrees. The rotation range of the F/E assembly about said F/E axis from a F/E datum position is between −70 degrees and 75 degrees. The rotational range may be any suitable sub range, including between about −70 degrees to about 0 degrees, 0 degrees to about 70 degrees, −60 to about 60 degrees, −30 to about 30 degrees, about −30 to about 75 degrees or about −70 degrees to about 30 degrees.

The P/S actuator can be interconnected to the base. In some embodiments, the F/E actuator can be interconnected to the P/S assembly, the A/A assembly or the base. In some embodiments, the A/A actuator can be interconnected to the P/S assembly and/or to the base.

The device can further include a second auxiliary bearing disposed on the P/S assembly. The F/E assembly can be operably interconnected to the P/S assembly via the second auxiliary bearing. Some embodiments of the invention to provide an exoskeleton with two or more actuators in a balanced position such that a latent or residual torque is not imparted on the degree of freedom related to the position. At least one actuator may be used for each degree of freedom. In the above example where the various assemblies are nested within each other, actuators drive the motion of the various assemblies, and the actuators are interconnected to some of the assemblies. For example, a F/E actuator is interconnected to the A/A assembly, and an A/A actuator is interconnected to the P/S assembly. If these actuators are placed on the same side of the axis about which the P/S assembly rotates, the P/S axis, then a torque is imparted on the P/S assembly. However, if these actuators are positioned on opposite sides of the P/S axis, then the torques imparted on the P/S axis are equal and in opposite directions such that the torques "cancel" out, and the various assemblies are in balance without a latent or residual torque imparted on any of the assemblies. In some embodiments, at least one weight or one spring may also be used to "cancel" a torque due to gravity.

While the apparatus allows for three degrees of freedom, it is possible that only two degrees of freedom or one degree of freedom is used to rotate a limb, while the remaining degree of freedom remains locked or unused.

The P/S actuator, the F/E actuator and/or the A/A actuator can each have a resistive mode, an active mode and/or a passive mode. The resistive mode can inhibit the motion of the limb. The active mode can assist the motion of the limb. The passive mode can allow for free motion of the limb. A user may select a mode for a patient.

The exoskeleton device can include a limb rest, which can be operably interconnected to the base. The limb rest can have a vertical adjustment feature that raises and lowers the limb rest relative to the P/S axis. The limb rest can have a lateral adjustment feature that extends and retracts the limb rest relative to the first P/S bearing. The limb rest can be a single piece, or multiple pieces.

Some or all of the apparatus may be made from metal, polymers or combinations thereof. In some embodiments, it may be beneficial to produce some or part of the apparatus from materials that make the apparatus light, but durable, such as titanium or carbon composites. In some embodiments, heavier metals, such as aluminum, may be used.

The base can be integrated to a table. In some embodiments of the invention, the device is in electronic communication with a display unit. The motion of a person's limb in the multiple degrees of freedom may affect what is displayed on the display unit, such as range, resistance, force, torque, and the like, for a user or another to review. Thus, a person's movement may allow the person to interact with games or other scenarios that make the person's use of the exoskeleton device more enjoyable.

An aspect of the invention is an exoskeleton device for articulating a limb. The device includes a base having a first P/S bearing and a second P/S bearing, wherein the first P/S bearing is a ring bearing configured to receive a portion of a limb through the first P/S bearing. The P/S assembly is operably interconnected to the base via the first and second P/S bearings. The P/S actuator is interconnected to the base, and is operably interconnected to the P/S assembly to rotate the P/S assembly about a P/S axis. The P/S assembly has a first F/E bearing and a second F/E bearing. The F/E assembly is operably interconnected to the P/S assembly via the first and second F/E bearings. The F/E actuator is interconnected to the P/S assembly, and the F/E actuator is operably interconnected to the F/E assembly to rotate the F/E assembly about a F/E axis. The F/E axis is substantially perpendicular to the P/S axis. A handle is operably interconnected to the F/E assembly and is configured to selectively interconnect to a portion of the limb. The handle has a handle axis that is substantially parallel to the F/E axis. The handle axis is offset from the F/E axis by an adjustable distance. A limb rest is operably interconnected to the base, and has a vertical adjustment feature that raises and lowers the limb rest relative to the P/S axis, and a lateral adjustment feature that extends and retracts the limb rest relative to said first P/S bearing.

Another aspect of the invention is a method for operating the exoskeleton device. The method may be performed manually or using a program, such as a software program. The method allows for a user to engage a limb to the device and measure or train the different variables associated with the limb, such as displacement, range of motion, force, strength, spasticity and other such variables. The method may include games to entertain the user while engaging the limb in exercises to measure or train the different variables associated with the limb.

Various embodiments of the present invention are described herein and as depicted in the drawings. It is expressly understood that although the figures show exoskeletons, assemblies with degrees of freedom, actuators, and other components, the present invention is not limited to these embodiments.

Now referring to FIG. 1, an exoskeleton device 2 with two degrees of freedom is provided. A base 4 is provided from which other components attach and operate from. The base 4 in this embodiment is a combination of modular elements. However it will be appreciated that the base 4 may be any structure that supports the components described herein. Two limb rests 6 are interconnected to the base 4. One limb rest 6 is oriented laterally with respect to the base 4, and this limb rest 6 is configured to receive an upper portion of a person's arm. Another limb rest 6 is oriented longitudinally with respect to the base 4, and this limb rest 6 is configured to receive a lower portion of the person's arm. Therefore, in this configuration, the person's elbow joint is positioned between the two limb rests 6.

Next, a pronation/supination (P/S) assembly 8 is interconnected to the base via a first P/S bearing 14 and a second P/S bearing 16. This rotatable interconnection allows the P/S assembly 8 to rotate about a P/S axis 22, and this is one degree of freedom for the exoskeleton device 2. The first P/S bearing 14 in this embodiment is a ring bearing, which is comprised of an outer ring positioned around an inner ring with ball bearings positioned therebetween. This type of first P/S bearing 14 provides an area through which a person may extend a distal portion of a limb, such as a hand, into the P/S assembly 8.

The second P/S bearing 16 also has an outer portion and an inner portion with ball bearings positioned therebetween, but the second P/S bearing 16 is smaller in size than the first P/S bearing 14. Further, the second P/S bearing 16 is positioned on the opposite side of the P/S assembly 8.

The P/S assembly 8 in this embodiment has a P/S frame that is generally comprised of a P/S longitudinal frame 10 and a P/S lateral frame 12. The P/S longitudinal frame 10 is oriented with the longitudinal direction of the base 4, and P/S longitudinal frame 10 is the portion of the P/S assembly that is operably interconnected to the base 4 via the first and second P/S bearings 14, 16. The P/S lateral frame 12 is oriented with the lateral direction of the base 4. In other words, the P/S lateral frame 12 is positioned perpendicularly to the P/S longitudinal frame 10, but it will be appreciated that other relative orientations are possible in other embodiments. As shown, other components of the exoskeleton device 2 may be interconnected or operably interconnect with the P/S longitudinal frame 10 and/or the P/S lateral frame 12.

A P/S actuator 18 is positioned on the same side of the P/S assembly 8 as the second P/S bearing 16, and the P/S actuator 18 powers the movement of the P/S assembly 8 about the P/S axis 22. The P/S actuator 18 in this embodiment is interconnected to a portion of the base 4. The P/S actuator 18 is operably interconnected to a P/S pulley 20, which in turn is interconnected to the P/S assembly 8. The operable interconnection between the P/S actuator 18 and the P/S pulley 20 in this embodiment is a pulley and capstan type of interconnection constituting a cable drive. A shaft or capstan extends from the P/S actuator 18 and aligns with an outer surface of the P/S pulley 20, and the P/S pulley's 20 outer surface is in the shape of a half circle. Thus, the P/S actuator 18 and its shaft drive the outer surface of the P/S pulley to rotate the P/S assembly 8 about the P/S axis 22. Given the typical range of the pronation and supination motions of the arm, the P/S pulley's 20 shape is only a half circle. However, it will be appreciated that the shape of the P/S pulley 20 and the type of operable interconnection between the P/S actuator 18 and the P/S pulley 20 may come in various forms. For example, the P/S pulley 20 may be a complete circle in shape such that the P/S assembly 8 may continuously rotate about the P/S axis 22 in one direction. Or in other embodiments, the P/S pulley 20 is optionally removed, and the P/S actuator 18 is directly interconnected to the P/S assembly 8, and the P/S actuator's 18 shaft is coaxial with the P/S axis 22.

Next, a flexion/extension (F/E) assembly 24 is positioned within the P/S assembly 8, and the F/E assembly 24 is operably interconnected to the P/S assembly 8 at a first F/E bearing 26 and a second F/E bearing 28. This operable interconnection allows the F/E assembly 24 to rotate about a F/E axis 30 that extends through the first and second F/E bearings 26, 28, which allows the F/E assembly 24 to accommodate the motion of, for example, a person's hand/palm flexing toward or away from the forearm. This motion represents a second degree of freedom for the exoskeleton device 2. The F/E assembly 8 also has an actuator and pulley combination that is discussed in further detail in FIG. 2 below.

A handle 32 having a handle axis 34 is interconnected to the F/E assembly. The handle 32 provides a location for a person to place a portion of the person's body such as the person's hand. Thus, the person may interact with the exoskeleton device 2 to perform various actions. In this embodiment, the handle axis 34 is substantially parallel with the F/E axis 30, and these axes 34, 30 are substantially perpendicular to the P/S axis 22. However, it will be appreciated that the exoskeleton device may have these various axes configured at other relative angles to accommodate various body parts and various desired motions.

Figure 2:
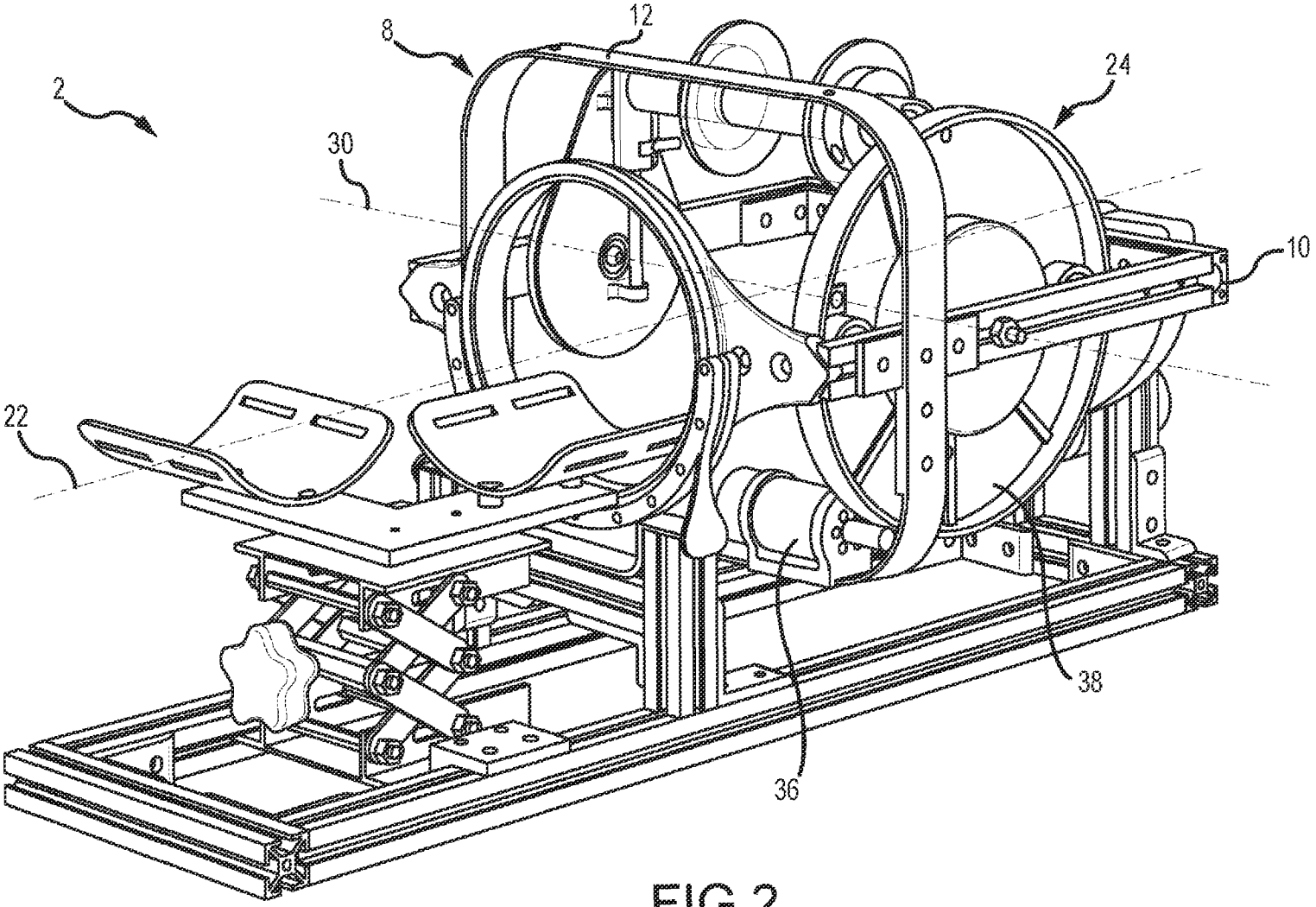
FIG. 2 is a perspective view of the exoskeleton device of FIG. 1 wherein one assembly has been rotated in accordance with various embodiments of the invention.

Now referring to FIG. 2, another perspective view of the exoskeleton device 2 is provided. The P/S assembly 8 has been rotated 90 degrees about the P/S axis 22. Now a F/E actuator 36 is visible, including the operable interconnection between the F/E actuator 36 and a F/E pulley 38. Similar to the operable interconnection between the P/S actuator 18 and P/S pulley 20, the F/E actuator 36 has a shaft that drives the outer surface of the F/E pulley 38 to rotate the F/E assembly 24 about the F/E axis 30. The F/E pulley 38 is a complete circle, but in other embodiments the F/E pulley 38 may comprise other shapes to accommodate other bodily motions.

Figure 3:
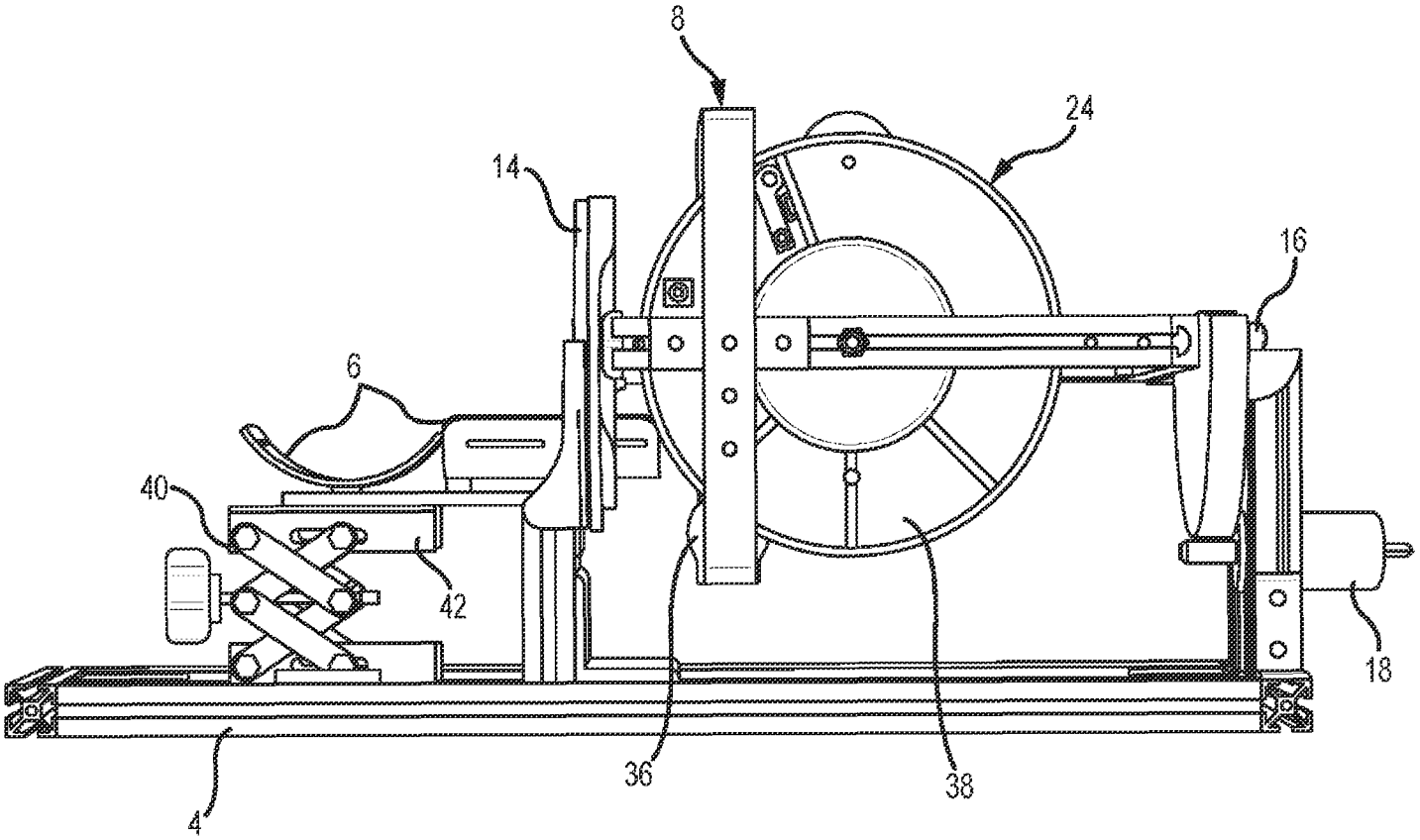
FIG. 3 is a side elevation view of the exoskeleton device of FIG. 1 in accordance with various embodiments of the invention.

Now referring to FIG. 3, a side elevation view of an exoskeleton device 2 is provided. The limb rest 6 that is oriented with the longitudinal direction of the base 4 is clearly shown. The limb rest 6 comprises a vertical adjustment feature 40 that raises and lowers the limb rest 6 relative to the P/S axis 22. In embodiments where the person extends the person's arm into the exoskeleton device 2, the person's forearm may be positioned substantially parallel with the P/S axis, and more specifically, substantially coaxial with the P/S axis. This allows the person to grasp the handle 32 and move the P/S assembly 8 with pronation and supination motions. Similarly, the limb rest 6 also has a lateral adjustment feature 42 that allows the limb rest 6 to be moved closer or further away from the first P/S bearing 14. The lateral adjustment feature 42 allows a person to place the person's forearm at a proper distance from the handle such that the person may comfortably grasp the handle.

Figure 4:
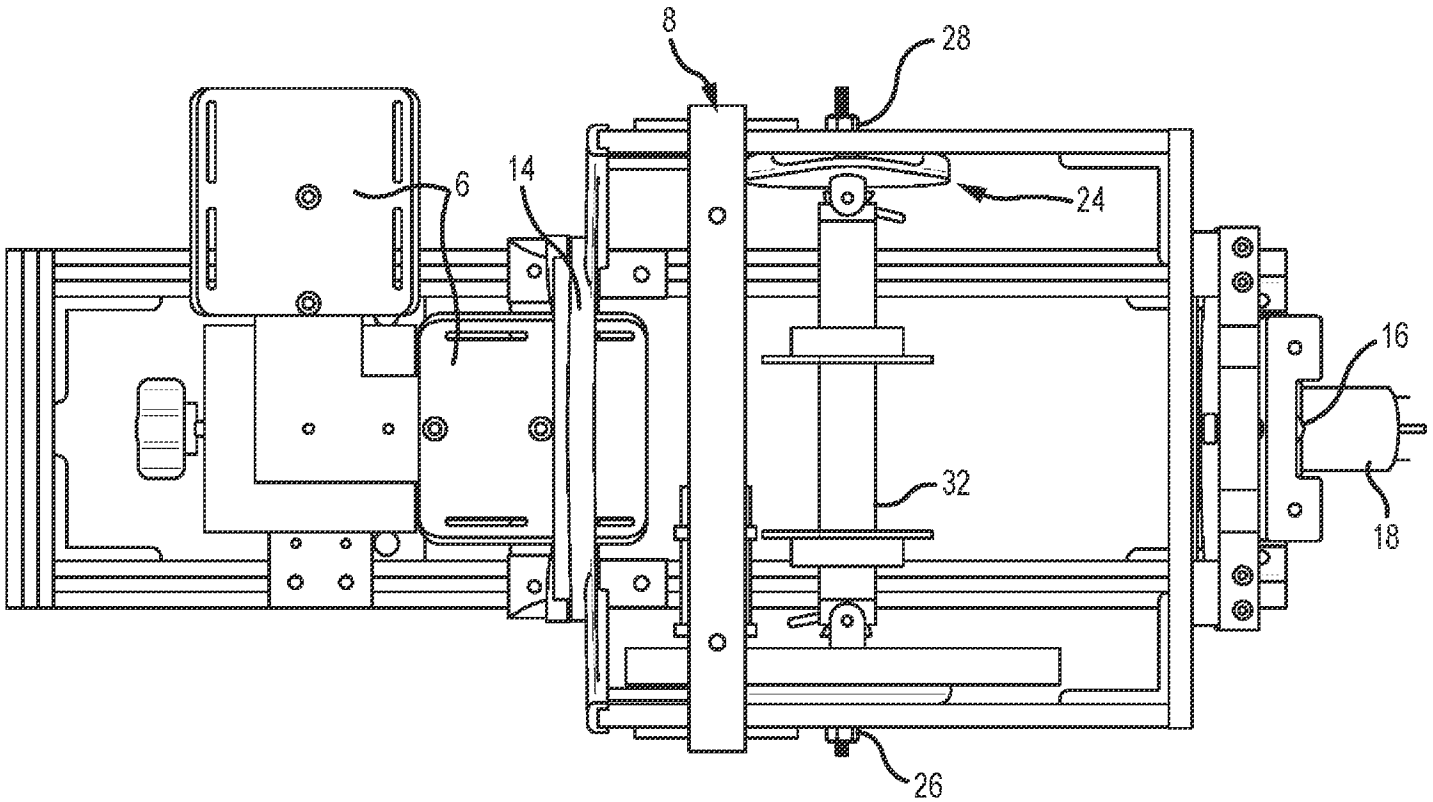
FIG. 4 is a top plan view of the exoskeleton device of FIG. 1 in accordance with various embodiments of the invention.

Now referring to FIG. 4, a top plan view of the exoskeleton device 2 is provided. The positions of the first and second P/S bearings 14, 16 are more clearly shown as well as the positions of the first and second F/E bearings 26, 28. In alternative embodiments, the P/S assembly 8 may be rotatably interconnected to the base 4 via only one P/S bearing. Similarly, the F/E assembly may be rotatably interconnected to the base 4 via only one F/E bearing. In these embodiments, increased moment forces will be applied to the bearings, but the exoskeleton may comprise more discrete frames that have fewer parts and less mass.

Figure 5:
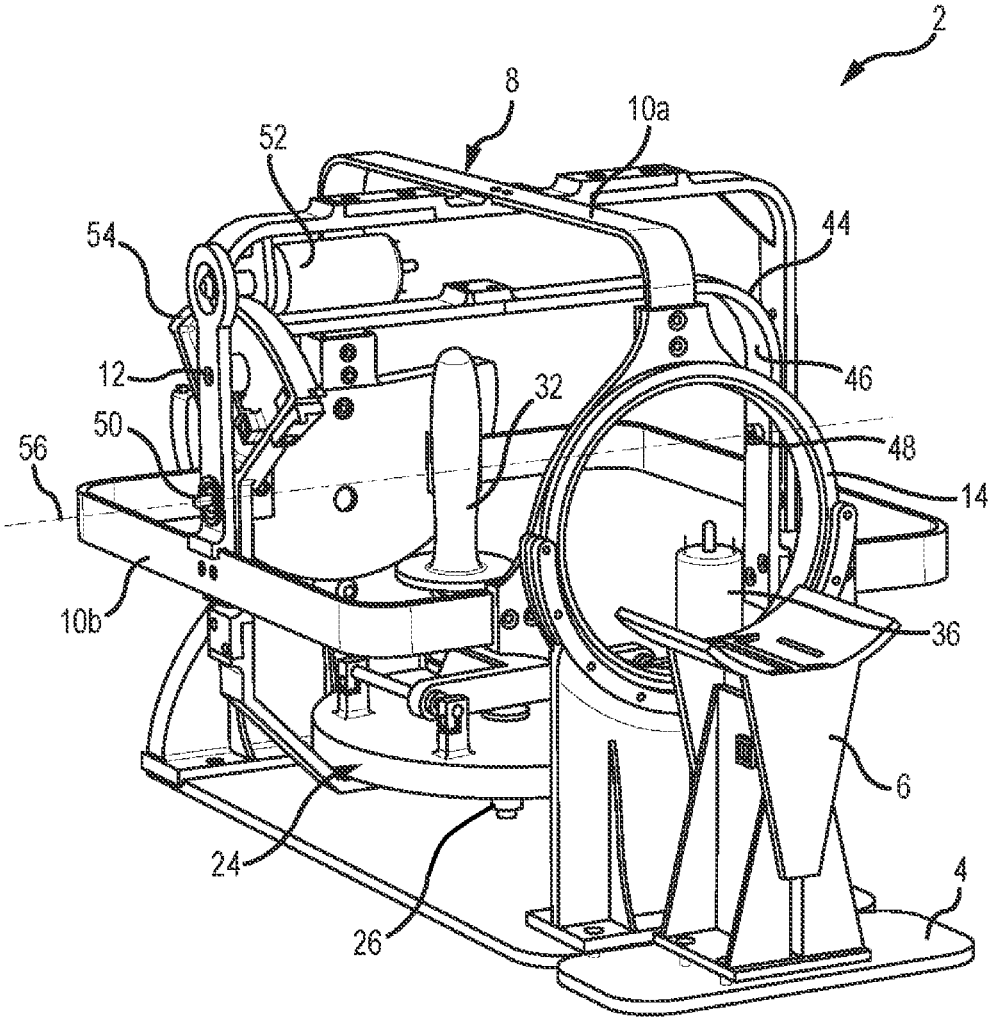
FIG. 5 is a perspective view of an exoskeleton device with three degrees of freedom in accordance with various embodiments of the invention.

Now referring to FIG. 5, a perspective view of an exoskeleton device 2 is provided that has three degrees of freedom. This embodiment shares some similarities to the embodiment or embodiments described in FIGS. 1-4. For example, the exoskeleton device 2 in FIG. 5 comprises a base 4 and a limb rest 6 to help align the person's body part with certain features of the exoskeleton device 2. The exoskeleton device 2 in FIG. 5 also comprises first and second P/S bearings that provide an operable interconnection between a P/S assembly 8 and the base 4. The P/S assembly 8 is also rotatable about a P/S axis, however, the P/S assembly 8 in FIG. 5 has a frame with more components. The P/S assembly 8 has two P/S longitudinal frames 10*a*,

10*b* that are offset from each other about the P/S axis by 90 degrees. A P/S lateral frame 12 is oriented with the lateral direction of the base 2 and is interconnected to the two P/S longitudinal frames 10*a*, 10*b* such that the P/S lateral frame 12 is perpendicular to the two P/S longitudinal frames 10*a*, 10*b*.

Next, an abductor/adductor (A/A) assembly 44 is mounted within the P/S assembly 8. A first A/A bearing 48 and a second A/A bearing 50 are disposed in the P/S lateral frame 12, and these bearings are operably interconnected to an A/A lateral frame 46 such that the A/A assembly 44 rotates about an A/A axis 56 that passes through the A/A bearings 48, 50. The A/A axis 56 in addition to the P/S axis 22 and the F/E axis 30 described in further detail below form the three major degrees of freedom for the exoskeleton device 2 in FIG. 5.

An A/A actuator 52 is interconnected to the P/S lateral frame 12, and the A/A actuator 52 is operably interconnected to an A/A pulley 54 on the A/A lateral frame 46. A shaft/capstan extends from the A/A actuator 52 and drives an outer surface of the A/A pulley 54, forming a cable drive mechanism, which in this embodiment is a partial arc shape. As described elsewhere herein, the shape of a pulley may vary to accommodate different design requirements. The A/A pulley 54 may also serve as a counterweight that is interconnected to the A/A assembly 44, the counterweight generates a torque about the A/A axis 56 in one direction, and the handle and/or the F/E pulley generate another torque about the A/A axis in the opposite direction, wherein the magnitude of the torques are equal and thus cancel out such that there is no latent or residual torque on the A/A assembly 44 or the A/A axis 56.

A F/E actuator 36 is interconnected to the A/A assembly 44, and the F/E actuator 36 is operably interconnected to a F/E assembly 24 to rotate the F/E assembly 24 a F/E axis as described in FIGS. 1-4 above. The positions of the A/A actuator 52 and the F/E actuator 36 place the various assemblies 8, 24, 44 of the exoskeleton device 2 in substantial balance. The P/S actuator is interconnected to the base 4, and thus does not affect the overall balance of the assemblies 8, 24, 44. However, the A/A actuator 52 and the F/E actuator 36 are generally placed on opposite sides of the P/S axis to maintain a balance of the various assemblies 8, 24, 44. Stated another way, if the F/E actuator 36 was interconnected to the same side of the A/A assembly 44 as the A/A pulley 54, then both the F/E actuator 36 and the A/A actuator 52 would be positioned on the same side of the P/S axis. This would result in a latent or residual torque about the P/S axis that would pull the P/S assembly 8 in a counterclockwise direction when viewed down the P/S axis from the limb rest 6 and the first P/S bearing 14. Conversely and as presented in FIG. 5, the F/E actuator 36 is positioned to the "lower right" of the P/S axis, and the A/A actuator 52 is positioned to the "upper left" of the P/S axis. Therefore, the F/E actuator 36 generates a torque in a first direction toward the second P/S bearing, and the A/A actuator 52 generates an equal torque in a second direction toward the first P/S bearing 14, and the two torques substantially "cancel" each other out. This leaves the various assemblies 8, 24, 44 in balance, and puts less strain on the P/S actuator.

Figure 6:
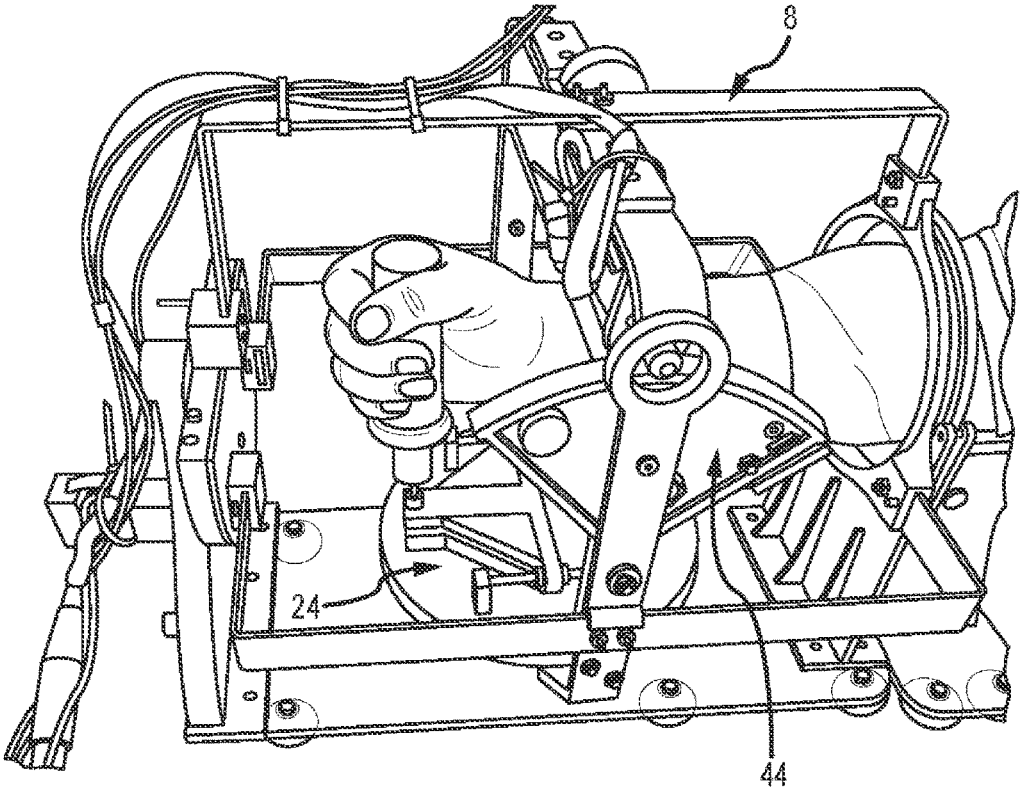
FIG. 6 is another perspective view of the exoskeleton device of FIG. 5 in accordance with various embodiments of the invention.

Now referring to FIG. 6, another perspective view of an exoskeleton device 2 with three degrees of freedom is provided. The P/S assembly 8, the A/A assembly 44, and the F/E assembly 24 are each rotatable about their respective axes to provide three degrees of freedom. However, embodiments of the invention are not limited to three rotational degrees of freedom. In other embodiments, the base 4 may translate positions in a plane. Specifically, the base 4 may comprise adjustable rails, linear bearings, or other similar devices that translate the base 4, and thus the various assemblies 8, 24, 44, in both the lateral and longitudinal directions of the base 4.

The various pulleys may relate to the general range of motion of a distal end of a limb such as a forearm, a wrist, and a hand. From a datum position or plane, the rotation range of the various assemblies about the various axes may be expressed in degrees. In some embodiments, a rotation range of the P/S assembly about the P/S axis from a P/S datum position is between approximately −70 degrees and 85 degrees. In various embodiments, a rotation range of the A/A assembly about the A/A axis from an A/A datum position is between approximately −20 degrees and 35 degrees. In some embodiments, a rotation range of the F/E assembly about the F/E axis from a F/E datum position is between −70 degrees and 75 degrees.

The embodiments of the exoskeleton devices 2 described herein may be in electronic communication with a display unit that is visible to a user. The user may move his or her hand, for example, in an exoskeleton device 2 to play a game or other scenario on the display unit. In one specific example, movements within the exoskeleton control a first area of the display unit that is a cursor. The person may move the cursor toward one or more second areas of the screen to demonstrate a range of motion. Therefore, the person's engagement of the exoskeleton device can be enhanced with a game-like experience, which may improve the outcome of the person's use of the exoskeleton device 2.

The present invention has significant benefits across a broad spectrum of endeavors. It is the Applicant's intent that this specification and the claims appended hereto be accorded a breadth in keeping with the scope and spirit of the present invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the present invention, brief description of the drawings, detailed description, abstract, and claims themselves.

The foregoing description of the present invention has been presented for illustration and description purposes. However, the description is not intended to limit the present invention to only the forms disclosed herein. In the foregoing Detailed Description for example, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the present invention.

Consequently, variations and modifications commensurate with the above teachings and skill and knowledge of the relevant art are within the scope of the present invention. The embodiments described herein above are further intended to explain best modes of practicing the present invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

The invention claimed is:

1. An exoskeleton device for articulating a limb, comprising:

a base having a first pronation/supination (P/S) bearing and a second P/S bearing, wherein said first P/S bearing is a ring bearing configured to receive a portion of a limb through said first P/S bearing;

a P/S assembly operably interconnected to said base via said first and second P/S bearings, wherein a P/S actuator is operably interconnected to said P/S assembly to rotate said P/S assembly about a P/S axis, said P/S assembly having a first auxiliary bearing, a P/S lateral frame, wherein at least a portion of the P/S lateral frame enclose said limb;

an auxiliary assembly operably interconnected to said P/S assembly via said first auxiliary bearing, wherein an auxiliary actuator is operably interconnected to said auxiliary assembly to rotate said auxiliary assembly about an auxiliary axis; and a securing feature operably interconnected to said auxiliary assembly, wherein said securing feature is configured to selectively interconnect to said portion of said limb.

2. The exoskeleton device of claim 1, wherein said securing feature is a handle having a handle axis, wherein said handle axis is substantially parallel to said auxiliary axis, and wherein said handle axis is offset from said auxiliary axis by a predetermined or an adjustable distance.

3. The exoskeleton device of claim 1, wherein said P/S axis and said auxiliary axis are substantially perpendicular to each other.

4. The exoskeleton device of claim 1, wherein said P/S actuator is interconnected to said base, and wherein said auxiliary actuator is interconnected to said P/S assembly.

5. The exoskeleton device of claim 1, further comprising:

a second auxiliary bearing disposed on said P/S assembly, wherein said auxiliary assembly is operably interconnected to said P/S assembly via said second auxiliary bearing.

6. The exoskeleton device of claim 1, wherein said P/S actuator has a resistive mode that inhibits motion of said limb, an active mode that assists motion of said limb, and a passive mode that allows free motion of said limb.

7. The exoskeleton device of claim 1, further comprising:

a limb rest operably interconnected to said base, said limb rest having a vertical adjustment feature that raises and lowers said limb rest relative to said P/S axis, and said limb rest having a lateral adjustment feature that extends and retracts said limb rest relative to said first P/S bearing.

8. The exoskeleton device of claim 1, wherein a rotation range of said P/S assembly about said P/S axis from a P/S datum position is between approximately −70 degrees and 85 degrees, wherein a rotation range of said auxiliary assembly about said auxiliary axis from an auxiliary datum position is between approximately −20 degrees and 35 degrees.

9. An apparatus for articulating a limb, comprising:

a base having a first pronation/supination (P/S) bearing and a second P/S bearing;

a P/S assembly operably interconnected to said base via said first and second P/S bearings, wherein a P/S actuator is operably interconnected to said P/S assembly to rotate said P/S assembly about a P/S axis, said P/S assembly having a first abductor/adductor (A/A) bearing, a P/S longitudinal frame, and a P/S lateral frame, wherein at least a portion of the P/S longitudinal frame and at least a portion of the P/S lateral frame enclose said limb;

an A/A assembly operably interconnected to said P/S assembly via said first A/A bearing, wherein an A/A actuator is operably interconnected to said A/A assembly to rotate said A/A assembly about an A/A axis, said A/A assembly having a first flexion/extension (F/E) bearing; and a F/E assembly operably interconnected to said A/A assembly via said first F/E bearing, wherein a F/E actuator is operably interconnected to said F/E assembly to rotate said F/E assembly about a F/E axis, said F/E assembly having a securing feature that is configured to selectively interconnect to a portion of a limb.

10. The apparatus of claim 9, wherein said securing feature is a handle having a handle axis, wherein said handle axis is substantially parallel to said F/E axis, and wherein said handle axis is offset from said F/E axis by a predetermined distance.

11. The apparatus of claim 9, wherein said P/S axis, said A/A axis, and said F/E axis are substantially perpendicular to each other.

12. The apparatus of claim 9, wherein said A/A actuator generates a first torque about said P/S axis in a first direction, and said F/E actuator generates a second torque about said P/S axis in a second direction, wherein said first torque is substantially equal to said second torque, and said first direction is substantially opposite of said second direction.

13. The apparatus of claim 9, wherein said P/S actuator is interconnected to said base, said A/A actuator is interconnected to said P/S assembly, and said F/E actuator is interconnected to said A/A assembly.

14. The apparatus of claim 9, further comprising:

a second A/A bearing disposed on said P/S assembly, wherein said A/A assembly is operably interconnected to said P/S assembly via said second A/A bearing; and a second F/E bearing disposed on said A/A assembly, wherein said F/E assembly is operably interconnected to said A/A assembly via said second F/E bearing.

15. The apparatus of claim 9, wherein said first P/S bearing is a ring bearing configured to receive said portion of said limb through said first P/S bearing.

16. The apparatus of claim 9, wherein said P/S actuator has a resistive mode that inhibits motion of said limb, an active mode that assists motion of said limb, and a passive mode that allows free motion of said limb.

17. The apparatus of claim 9, further comprising:

a limb rest operably interconnected to said base, said limb rest having a vertical adjustment feature that raises and lowers said limb rest relative to said P/S axis, and said limb rest having a lateral adjustment feature that extends and retracts said limb rest relative to said first P/S bearing.

18. The apparatus of claim 9, further comprising:

a counterweight interconnected to said A/A assembly, said counterweight generates a third torque about said A/A axis in a third direction, and said securing feature generates a fourth torque about said A/A axis in a fourth direction, wherein said third torque is substantially equal to said fourth torque, and said third direction is substantially opposite of said fourth direction.

19. The apparatus of claim 9, wherein a rotation range of said P/S assembly about said P/S axis from a P/S datum position is between approximately −70 degrees and 85 degrees, wherein a rotation range of said A/A assembly about said A/A axis from an A/A datum position is between approximately −20 degrees and 35 degrees, and wherein a rotation range of said F/E assembly about said F/E axis from a F/E datum position is between −70 degrees and 75 degrees.

20. An exoskeleton device for articulating a limb, comprising:

a base having a first pronation/supination (P/S) bearing and a second P/S bearing, wherein said first P/S bearing is a ring bearing configured to receive a portion of a limb through said first P/S bearing;

a P/S assembly operably interconnected to said base via said first and second P/S bearings, wherein a P/S actuator is interconnected to said base, said P/S actuator is operably interconnected to said P/S assembly to rotate said P/S assembly about a P/S axis, said P/S assembly having a first flexion/extension (F/E) bearing, a second F/E bearing, and a P/S longitudinal frame, wherein at least a portion of the P/S longitudinal frame enclose said limb;

a F/E assembly operably interconnected to said P/S assembly via said first and second F/E bearings, wherein a F/E actuator is interconnected to said P/S assembly, said F/E actuator is operably interconnected to said F/E assembly to rotate said F/E assembly about a F/E axis, wherein said F/E axis is substantially perpendicular to said P/S axis;

a handle operably interconnected to said F/E assembly, wherein said handle is configured to selectively interconnect to said portion of said limb, said handle having a handle axis substantially parallel to said F/E axis, and wherein said handle axis is offset from said F/E axis by a predetermined or adjustable distance; and a limb rest operably interconnected to said base, said limb rest having a vertical adjustment feature that raises and lowers said limb rest relative to said P/S axis, and said limb rest having a lateral adjustment feature that extends and retracts said limb rest relative to said first P/S bearing.

* * * * *